US007086094B1

(12) United States Patent
Ismailyan

(10) Patent No.: US 7,086,094 B1
(45) Date of Patent: Aug. 8, 2006

(54) ERASER GLOVE

(76) Inventor: Vram Ismailyan, 1122 Irving Ave., Glendale, CA (US) 91201

( * ) Notice: Subject to any disclaimer, the term of this patent is extended or adjusted under 35 U.S.C. 154(b) by 0 days.

(21) Appl. No.: 10/992,541

(22) Filed: Nov. 18, 2004

(51) Int. Cl.
*A41D 19/00* (2006.01)

(52) U.S. Cl. ..... 2/159

(58) Field of Classification Search ..... 2/16, 2/20, 159, 160, 161.6, 162, 163; 15/227, 15/425, 443; 401/6–8
See application file for complete search history.

(56) References Cited

U.S. PATENT DOCUMENTS

| | | | | |
|---|---|---|---|---|
| 3,593,339 | A * | 7/1971 | Main et al. | 2/161.6 |
| 3,735,442 | A * | 5/1973 | Lukas | 15/227 |
| 3,787,898 | A * | 1/1974 | Walker | 2/163 |
| 4,103,362 | A | 8/1978 | Blakeman | 2/161 |
| 4,747,163 | A * | 5/1988 | Dzierson | 2/161.1 |
| D320,229 | S | 9/1991 | Frazier | D19/53 |
| 5,218,719 | A * | 6/1993 | Johnson | 2/19 |
| 5,530,984 | A | 7/1996 | Walker | 15/209.1 |
| 5,697,104 | A * | 12/1997 | Welton | 2/159 |
| 6,098,200 | A * | 8/2000 | Minkow et al. | 2/161.1 |
| 2003/0213081 | A1* | 11/2003 | Garcia | 15/227 |

* cited by examiner

*Primary Examiner*—Gary L. Welch
(74) *Attorney, Agent, or Firm*—Goldstein Law Offices PC.

(57) ABSTRACT

An eraser glove for use erasing markings from a board, chalkboard or whiteboard, by a user having a hand and wrist. The eraser glove has an elastic wristband and a form-fitting glove having three half-fingers for covering a thumb, ring finger, and pinkie finger of the hand of the user. The elastic wristband secures around the wrist of the user for ensuring a secure comfortable fit. An absorbent layer is coupled to the form-fitting glove for capturing erased markings from the board.

1 Claim, 2 Drawing Sheets

ERASER GLOVE

BACKGROUND OF THE INVENTION

The invention relates to a glove, and more particularly, to a three-fingered eraser glove for use easily erasing chalkboards and whiteboards.

First widely used in the United Sates in the mid-1800s, the schoolroom chalkboard was itself revolutionary, replacing handheld slate as schools began educating larger numbers of students. While the old-fashioned chalkboard remains a fixture in most U.S. classrooms, school designers have all but eliminated it. Taking a page from the business world, they are outfitting most new and remolded schools with whiteboards, or plastic coated boards that are written on with erasable markers. While the popularity of dry-erase whiteboards took off in the 1990s, these days most are actually made of the same stuff as chalkboards: a thin coating or porcelain over steel. Chalkboards get a satin finish so the chalk will bite, while whiteboards get a glossy finish. Both of these boards are invaluable tools in classrooms and boardrooms, allowing instructors and presenters to convey a plethora of important information in a manner that is easily seen by students and business associates. And with only a quick swipe of an erase, each board is instantly ready for another round of writing.

U.S. Pat. No. 5,530,984 to Walker discloses a frame and handle assembly for use in wiping a chalkboard clean. U.S. Pat. No. 4,103,362 to Blakeman discloses a glove for covering the knuckles, thumb, index and middle finger, however, for playing billboards. United States Pat. No. D320,229 to Frazier discloses an ornamental design for an eraser.

While these units may be suitable for the particular purpose employed, or for general use, they would not be as suitable for the purposes of the present invention as disclosed hereafter.

SUMMARY OF THE INVENTION

It is an object of the invention to produce a glove that can conveniently and effectively erase a chalkboard or whiteboard, while keeping the hands and clothing free from chalk dust and marks. Accordingly, the invention is an eraser glove, having a form-fitting glove having an absorbent material, padded polyester, and an elastic wristband for conveniently and effectively erasing a chalkboard or whiteboard, while keeping the hands and clothing free from chalk dust and marks.

It is another object of the invention to provide an eraser glove that alleviates the mess caused by chalk dust. Accordingly, the absorbent material of the form-fitting glove captures erased chalk within its material, rather than scattering it so that it does not cover the hands and clothing.

It is another object of the invention to provide an eraser glove that is extremely easy to use and capable of being worn for long periods of time. According, the padded polyester along with the elastic wristband, are easily donned and removed in a matter of seconds and conveniently offer a secure and comfortable fit when used for extended periods of time.

This invention is an eraser glove for use erasing markings from a board, chalkboard or whiteboard, by a user having a hand and wrist. The eraser glove has an elastic wristband and a form-fitting glove having three half-fingers for covering a thumb, ring finger, and pinkie finger of the hand of the user. The elastic wristband secures around the wrist of the user for ensuring a secure comfortable fit. An absorbent layer is coupled to the form-fitting glove for capturing erased markings from the board.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
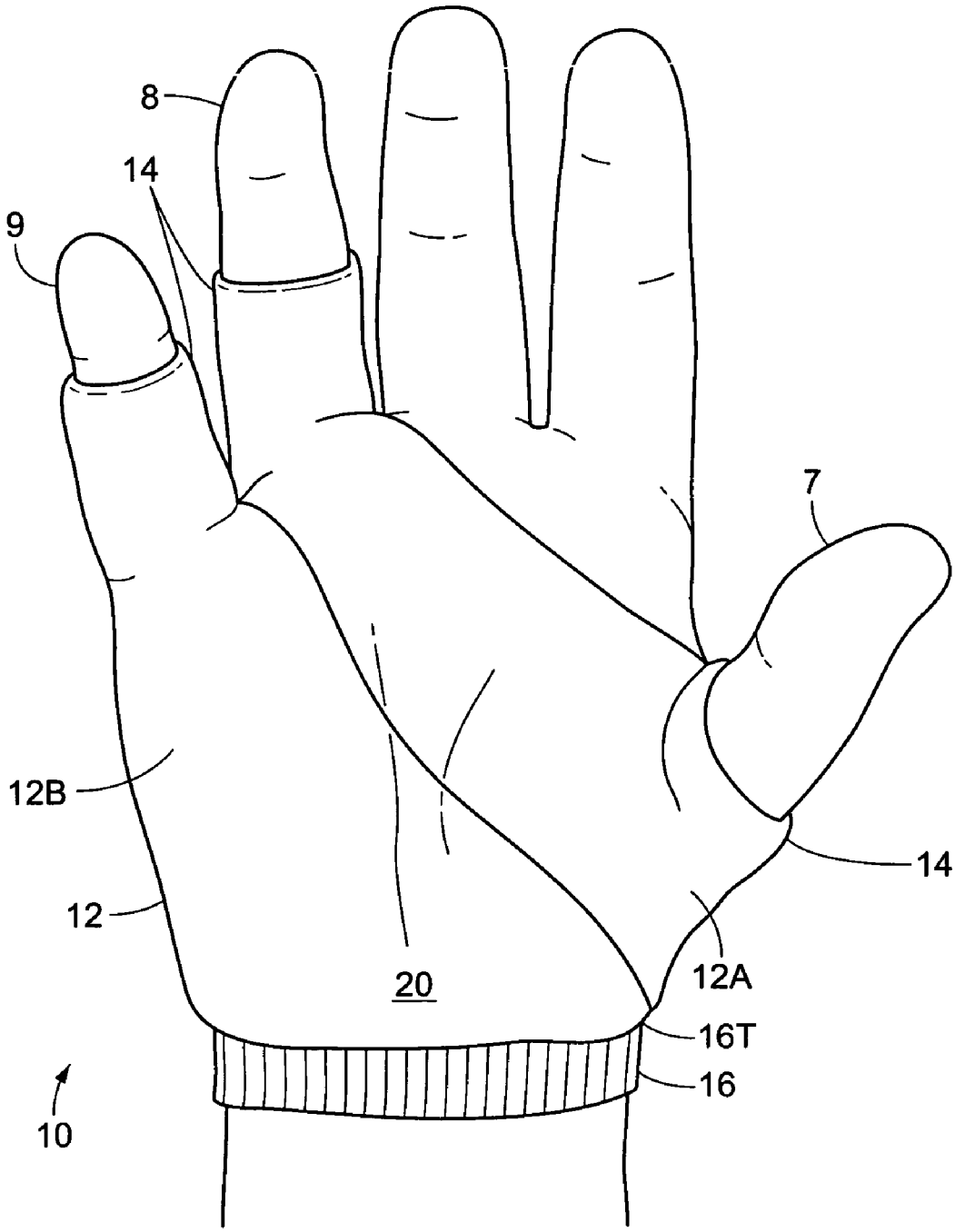
FIG. 1 is a diagrammatic perspective view of the eraser glove of the present invention having a form-fitting glove, having three half-fingers for covering a thumb, ring finger, and pinkie finger of a hand of a user.

FIG. 1 illustrates an eraser glove 10 of the present invention for use erasing chalkboards and whiteboards. The eraser glove 10 has a form-fitting glove 12, having three half-fingers 14 for covering a thumb 7, ring finger 8, and pinkie finger 9 of a hand of a user. The hand of the user has a palm, which is attached to a wrist. The form-fitting glove 12 of the eraser glove 10 is made for both right handed and left handed users.

The form-fitting glove 12 has a first half 12A, a second half 12B, and an elastic wristband 16. The elastic wristband has a top edge 16T. The elastic wristband 16 secures around the wrist of the user for ensuring a secure comfortable fit. The first half 12A of the form-fitting glove 12 extends from the top edge 16T of the elastic wristband 16 across the palm of the hand and covers the thumb and the ring finger. The second half 12B of the form-fitting glove 12 covers the remainder of the hand of the user, including the remainder of the palm and pinkie finger. Preferably, the first half 12A of the form-fitting glove 12 is made out of padded polyester and the second half 12B of the form-fitting glove 12 has an absorbent layer 20 including either a black felt material or soft pile fabric. The absorbent layer 20 of the form-fitting glove 12 captures erased chalk, rather than scattering the chalk so that it does not cover the hands and clothing. The second half 12B of the form-fitting glove 12 is used to erase chalkboards with the black felt material, and whiteboards with the soft pile fabric.

Figure 2:
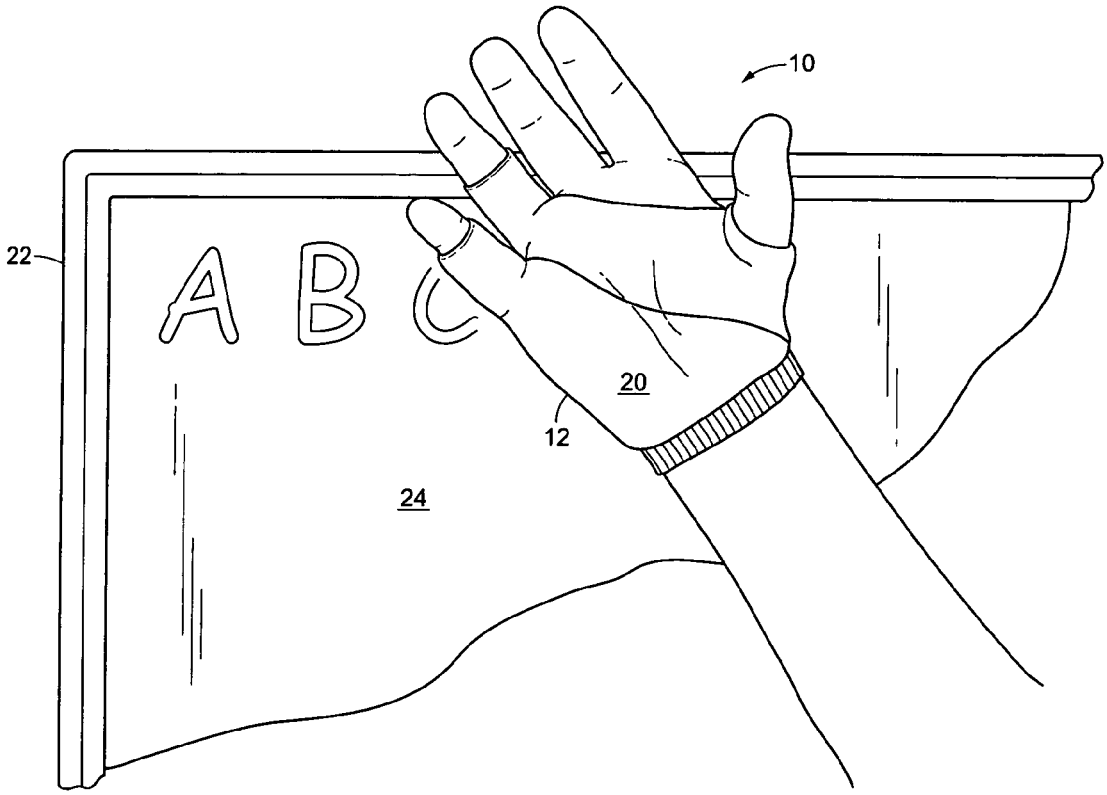
FIG. 2 is a diagrammatic perspective view of the eraser glove of the present invention in use effectively erasing a chalkboard.

FIG. 2 illustrates the eraser glove 10 of the present invention in use erasing a board 22, having a surface 24. First, the user selects the form-fitting glove 12 based on the type of board 22, chalkboard or whiteboard, as well as the dominant hand. Next, the user would slip the form-fitting glove 12 onto the hand, as one would a standard glove. The user would then select a piece of chalk or marker and begin writing on the board 22. If an error is made while writing, or the board 22 needs to be cleared to write additional material, the user need only place the absorbent layer 20 flushly against the surface 24 of the board 22. With simple wiping motions the user can instantly erase the markings.

In conclusion, herein is presented an eraser glove for use easily erasing chalkboards and whiteboards. The invention is illustrated by example in the drawing figures, and throughout the written description. It should be understood that numerous variations are possible, while adhering to the inventive concept. Such variations are contemplated as being a part of the present invention.

What is claimed is:

1. An eraser glove for use erasing markings on boards, including chalkboards and whiteboards, by a user having a hand, wrist, palm, thumb, ringer finger and pinkie finger, comprising:

a form-fitting glove having an elastic wristband, a first half, and a second half, the elastic wristband having a top edge that secures around the wrist of the user for ensuring a secure comfortable fit, the first half extending from the top edge of the elastic wristband across the palm of the hand and covering the thumb and the ring finger, the second half covering the remainder of the hand of the user, including the remainder of the palm and pinkie finger;

a three half-fingers for covering the thumb, ring finger, and pinkie finger of the hand of the user; and an absorbent layer coupled to the second half of the form-fitting glove for capturing erased markings from the board.

* * * * *